US008646600B2

(12) United States Patent
Amatrudo

(10) Patent No.: US 8,646,600 B2
(45) Date of Patent: Feb. 11, 2014

(54) BLOW-MOLDED TOOL KIT

(75) Inventor: Andrew Gary Amatrudo, North Branford, CT (US)

(73) Assignee: The Plastic Forming Company, Inc., Woodbridge, CT (US)

( * ) Notice: Subject to any disclaimer, the term of this patent is extended or adjusted under 35 U.S.C. 154(b) by 189 days.

(21) Appl. No.: 13/096,671

(22) Filed: Apr. 28, 2011

(65) Prior Publication Data

US 2012/0273377 A1 Nov. 1, 2012

(51) Int. Cl.
*B65D 85/28* (2006.01)

(52) U.S. Cl.
USPC ..... 206/373; 53/474

(58) Field of Classification Search
USPC ..... 206/372–378; 211/69, 70.6; 53/467, 53/473, 474
See application file for complete search history.

(56) References Cited

U.S. PATENT DOCUMENTS

| | | | | |
|---|---|---|---|---|
| 5,887,715 | A | 3/1999 | Vasudeva | |
| 6,375,007 | B1 * | 4/2002 | Huang | 206/373 |
| 6,415,922 | B1 | 7/2002 | Lee | |
| 6,626,295 | B1 | 9/2003 | Vasudeva | |
| 7,225,923 | B2 | 6/2007 | Hallee et al. | |
| 7,246,704 | B2 | 7/2007 | Brunson et al. | |
| 7,600,640 | B2 | 10/2009 | Hallee et al. | |
| 2002/0117413 | A1 * | 8/2002 | Ling | 206/373 |
| 2004/0069668 | A1 * | 4/2004 | Finnigan | 206/372 |
| 2005/0161357 | A1 | 7/2005 | Allan et al. | |
| 2006/0070900 | A1 * | 4/2006 | Brunson et al. | 206/373 |
| 2007/0272572 | A1 * | 11/2007 | Chen | 206/373 |
| 2009/0020447 | A1 * | 1/2009 | Potterfield et al. | 206/373 |

* cited by examiner

*Primary Examiner* — Luan K Bui
(74) *Attorney, Agent, or Firm* — St. Onge Steward Johnston & Reens LLC

(57) ABSTRACT

A tool kit for accommodating two tools having different sizes is provided including a tool case having a base member, a lid member hingedly connected to the base member, and a tool cavity formed by at least one of the base and lid members and having an inner surface. The tool kit further includes at least one adapter fittable in the tool cavity and having an outer surface that corresponds to the inner surface of the tool cavity, wherein the inner surface of the tool cavity corresponds to an outer periphery of the first tool such that the first tool is securely retained in the tool cavity, and wherein the inner surface of the tool cavity and the outer surface of the adapter received in the tool cavity correspond to an outer periphery of the second tool such that the second tool is securely retained in the tool cavity.

24 Claims, 10 Drawing Sheets

BLOW-MOLDED TOOL KIT

FIELD OF THE INVENTION

The present invention relates to a tool kit, and more particularly to a blow-molded tool kit including a tool case and a plurality of removable adapters to accommodate a plurality of tools of different sizes and corresponding tool accessories.

BACKGROUND OF THE INVENTION

The use of blow-molding as a method for manufacturing various sorts of articles is generally well known. Typically, this process involves the use of a mold consisting of two separate halves or portions having cavities of particularly desired shapes and sizes. Usually, one extrudes a large-diameter, sealed tube of molten material (commonly referred to as a "parison"), places the tube between the mold halves, and closes the mold around the tube. Fluid pressure is then introduced into the tube, forcing the molten tube against the walls of the cavities, conforming the tube to the shape thereof. The pressure is maintained until the molten material cools and solidifies. The pressure is then released, the mold halves are pulled apart, and the hardened article is ejected therefrom.

Many types of articles are manufactured in this manner in order to produce a double wall body. By producing an article in this manner, one is able to easily create an article that has two, hard plastic walls with a buffering space between them, thereby resulting in a body with a multitude of desirable physical characteristics, such as strength, rigidity, scuff resistance, and impact absorption, but that is also relatively inexpensive to manufacture. Because blow molding is a fairly simple way of producing a double wall article which is both inexpensive and lightweight, yet also strong and durable, it is not uncommon to use this method for manufacturing various types of housings and cases for machinery, tools, and industrial applications.

The blow molding of various types of cases has been a proven commercial process for many years. Blow-molded carrying cases are often used to compartmentalize power tools with accessories or multi-component instrument kits. These blow-molded cases have the advantage of being lighter weight than cases made of other materials, as the blow-molded designs are lighter than cases made of metals such as steel, titanium, copper, or wood and other heavy materials.

Along with being relatively lightweight, most blow-molded cases are integrally compartmented in their interiors to retain and position assortments of contents. Examples of such contents would be various power tools and tools used for day-to-day operations, such as a wrench set, screwdriver, washer, or nails.

In order to meet consumer demand, blow-molded carrying cases are mass produced and the efficient and cost effective production of these items is a goal for manufacturers. Various designs and improvements in these blow molded carrying cases provide for advantages, which can decrease manufacturing cost and increase sales, as the advantages provide for better and more user-friendly designs for consumers. In order to improve the efficiency and cost-effectiveness of the blow-molded tool cases, it is desirable to consolidate several tool kits, which combine multiple common accessories with one of multiple tools or instruments. This is typically achieved by providing an individual case that accommodates each individual instrument or tool, as well as the accessories dedicated to that instrument or tool. Other known tool cases are designed to accommodate a plurality of smaller accessories that are used with a particular tool type, such as drill bits, nails, sockets, screwdriver shanks and tips, bores, etc.

Several examples of such tool cases are known in the prior art. For example, U.S. Pat. Nos. 7,600,640 and 7,225,923 to Hallee et al. disclose a tool case for storage of drill bits or similarly shaped tools. The case includes a top portion and a bottom portion hingedly connected to each other and forming a cavity. The case also includes a plurality of tool trays disposed within the case and removably attached to the top and bottom portions by snapping male protrusions located on each tray into corresponding female recesses located on an inner surface of the cavity.

US Patent Application No. 2004/0069668 to Finnigan similarly discloses a tool case with a plurality of tool trays fittable into inner compartments of the tool case. The tool trays accommodate a plurality of drill bits and are secured within the case by a plurality of lugs on the side walls on the inner compartments which cooperate with sockets in the wall portions of the tool trays.

U.S. Pat. No. 6,415,922 to Lee discloses a tool case with a plurality of removable trays, wherein each tray is adapted to accommodate a plurality of tool accessories. Each tray is releasably secured within the tool case by means of flanges positioned on the inner surface of the case, which engage with recesses at opposed ends of the tray, such that the number and/or configuration of the trays can be easily varies according to the type and/or number of tool accessories stored in the case.

U.S. Pat. Nos. 5,887,715 and 6,626,295 to Vasudeva disclose a tool case with a storage space which is accessed from the inside of the tool case. The storage space is fitted with various pre-assembled snap-in storage modules to provide the user with flexibility of storing various items in various ways. The case includes a rectangular opening within its inner surface, with interior walls projecting upwardly from the opening to define the storage space. The module is secured within the storage space by inserting two tabs projecting outwardly from the module into corresponding slits located within adjacent interior wall.

However, the above described prior art tool cases still suffer from a number of disadvantages. For example, while these known tool cases are adapted to accommodate a plurality of tool accessories, they can typically only accommodate one particular type of a tool, thereby still requiring separate tool cases for each individual tool. Additionally, the prior art tool cases often have a complex structure requiring numerous components that can be easily misplaced by a consumer. Further, known tool cases typically include generalized pocketing since any compartment designed to hold more than one item requires space for the greatest dimension of the entire grouping of components. Such configuration generally fails to adequately retain components in their designated locations.

What is desired, therefore, is a tool kit which is easy and inexpensive to produce relative to known designs and which includes a plurality of adapters to accommodate a plurality of tools of different sizes and corresponding tool accessories. It is also desirable to provide a tool kit that minimizes the need for significant case interior redesign and/or alterations to hold each configuration of the kit and also reduces storage space by providing a single master tool case that can be stocked with a variety of adapters for later assembly as each individual configuration is needed. It is further desirable to provide a tool kit that is more economical and allows more flexibility to manufacturers by providing a master tool case with a plurality of adapters that accommodate different tool variations at a reasonable cost. It is yet further desirable to provide a tool kit that allows manufacturers to later design new adapters, or produce additional ones, as tools change or are added to the tool kits.

SUMMARY OF THE INVENTION

Accordingly, it is an object of the present invention to provide a tool kit that is easy and inexpensive to produce relative to known designs and which includes a plurality of adapters to accommodate a plurality of tools of different sizes and corresponding tool accessories.

It is also an object of the present invention to provide a tool kit that minimizes the need for significant case interior redesign and/or alterations to hold each configuration of the kit.

It is further an object of the present invention to provide a tool kit that reduces storage space by providing a single master tool case that can be stocked with a variety of adapters for later assembly as each individual configuration is needed.

It is yet a further object of the present invention to provide a tool kit that is more economical and allows more flexibility to manufacturers, who need quantities of tool variations smaller than would be economical to produce a case for, by providing a master tool case with a plurality of adapters that accommodate such tool variations at a reasonable cost.

It is a further object of the present invention to provide a tool kit that allows manufacturers to later redesign new adapters, or produce additional ones, as tools change or are added to the tool kits.

In order to overcome the deficiencies of the prior art and to achieve at least some of the objects and advantages listed, the invention comprises a tool kit for accommodating a first tool and a second tool having different sizes, the tool kit including a tool case having a base member, a lid member hingedly connected to the base member, and a tool cavity formed by at least one of the base member and the lid member and having an inner surface. The tool kit further includes at least one adapter fittable in the tool cavity and having an outer surface that corresponds to the inner surface of the tool cavity, wherein the inner surface of the tool cavity corresponds to an outer periphery of the first tool such that the first tool is securely retained in the tool cavity, and wherein the inner surface of the tool cavity and the outer surface of the at least one adapter received in the tool cavity correspond to an outer periphery of the second tool such that the second tool is securely retained in the tool cavity.

In certain embodiments, the tool kit further includes a plurality of accessory cavities formed by at least one of the base member and the lid member for accommodating a plurality of tool accessories.

In some embodiments, each of the base member and the lid member are blow molded such that each of the base member and the lid member has an exterior wall, an interior wall, and an internal space between the exterior wall and the interior wall.

In certain embodiments, the inner surface of the tool cavity includes at least one connector for removably connecting the at least one adapter to the tool cavity. In some of those embodiments, at least one connector has at least one first connector component positioned on the inner surface of the tool cavity and at least one second connector component positioned on the outer surface of the at least one adapter. In further of those embodiments, the at least one first connector component is a male connector component, and the at least one second connector component is a female connector component.

In some embodiments, the at least one adapter includes a first adapter removably fittable in the tool cavity for accommodating the second tool and a second adapter removably fittable in the tool cavity for accommodating a third tool.

In certain embodiments, the tool case further includes a handle attached to the tool case to facilitate carrying of the tool case.

In some embodiments, the lid member and the base member are movable from an open position to a closed position. In certain embodiments, the tool case further includes at least one locking mechanism for retaining the lid member in the closed position.

In some cases, the tool cavity is formed at least partially by an inner wall of the lid member and an inner wall of the base member. In other cases, the tool cavity is formed by an inner wall of the base member.

In certain embodiments, the first tool includes at least one of a single tool and a plurality of tools. In other embodiments, the second tool includes at least one of a single tool and a plurality of tools. In further embodiments, the third tool includes at least one of a single tool and a plurality of tools.

In some cases, the tool cavity has a length, a width and a height, and the at least one adapter alters at least one of the length, width and height of the tool cavity when received in the cavity.

An adapter for use in a tool kit is also provided, including an outer wall and at least one connector provided on the outer wall for connecting the adapter to a cavity in a tool case, wherein the outer wall corresponds to an inner surface of the cavity, and wherein the adapter accommodates at least one tool collection when positioned in the cavity.

In some embodiments, the adapter is blow molded such that the adapter has the outer wall and an internal space enclosed by the outer wall.

In certain embodiments, the at least one connector is a female connector that engages a male connector provided in the cavity of the tool case.

A method for packaging a tool collection in a tool case is further provided, inlcuding the step of providing a tool case having a base member, a lid member hingedly connected to the base member, and a tool cavity formed by at least one of the base member and the lid member and having an inner surface. The method also includes the steps of positioning at least one adapter in the tool cavity, the at least one adapter having an outer surface that corresponds to the inner surface of the tool cavity, and positioning the tool collection in the tool cavity, wherein the inner surface of the tool cavity and the outer surface of the at least one adapter received in the tool cavity correspond to an outer periphery of the tool collection such that the tool collection is securely retained in the tool cavity.

In some embodiments, the step of positioning at least one adapter in the tool cavity includes engaging at least one first connector component positioned on the inner surface of the tool cavity with at least one second connector component positioned on the outer surface of he at least one adapter.

In certain embodiments, the method further includes the step of attaching a handle to the tool case to facilitate carrying of the case.

In some cases, each of the base member and the lid member are blow molded such that each of the base member and the lid member has an exterior wall, an interior wall, and an internal space between the exterior wall and the interior wall.

In certain embodiments, the method further includes the step of positioning at least one tool accessory in an accessory cavity provided in the tool case.

In some embodiments, the tool collection inlcudes at least one of a single tool and a plurality of tools.

Other objects of the invention and its particular features and advantages will become more apparent from consideration of the following drawings and accompanying detailed description.

DETAILED DESCRIPTION OF THE INVENTION

Figure 1:
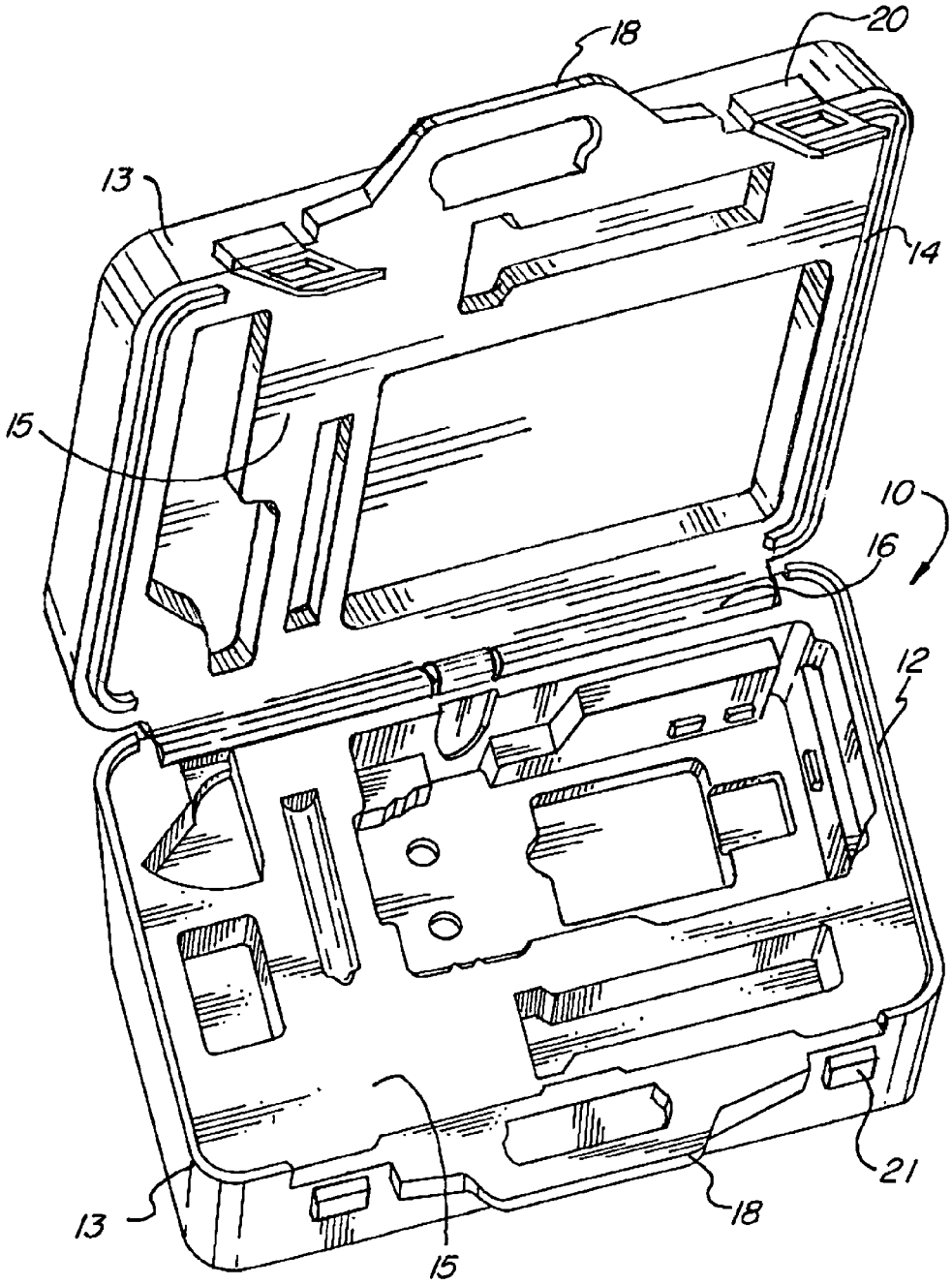
FIG. 1 is front isometric view of a tool case according to an exemplary embodiment of the present invention.

The basic components of one embodiment of a blow-molded case with adapters in accordance with the invention are illustrated in FIG. 1. As used in the description, the terms "top," "bottom," "above," "below," "over," "under," "above," "beneath," "on top," "underneath," "up," "down," "upper," "lower," "front," "rear," "back," "forward" and "backward" refer to the objects referenced when in the orientation illustrated in the drawings, which orientation is not necessary for achieving the objects of the invention.

Referring to FIG. 1, an exemplary embodiment of a tool case (10) in accordance with the present invention is shown. The tool case (10) includes a base member (12) and a lid member (14) connected thereto. The base member (12) and the lid member (14) are preferably, but not necessarily, blow molded articles formed by single or separate blow molding processes. As illustrated in FIG. 1, the lid member (14) and the base member (12) each have an exterior wall (13), an interior wall (15), and an internal space between the interior and exterior walls. In some embodiments, the lid portion (12) may include a translucent section (not shown) for viewing objects contained in the tool case (10).

The base member (12) and the lid member (14) are connected to each other by a hinge (16) such that the lid member (14) is pivotable between an open position and a closed position. When the base member (12) and the lid member (14) are in the open position, the lid and base members are in a coplanar configuration. When in the closed position, the lid member (14) is adjacent to the base member (12) and a closed position, in which the lid member (14) covers the base member (12) and at least partly covers any objects, such as tools, accommodated in the tool case (10).

In the exemplary embodiment shown in FIG. 1, the base member (12) and the lid member (14) include a handle portion (18) to facilitate carrying of the tool case (10) by a user. In some embodiments, the handle (18) is integrally molded with the base member (12) and the lid member (14). It should be noted, however, that the handle (18) can be manufactured separately and then removably or permanently attached to the base member (12) and the lid member (14). When the tool case (10) is the closed position, the two handle portions (18) are joined together, thus forming a single handle. It is understood, however, that the handle can be positioned only on the lid member (14) or only on the base member (12) without departing from the spirit of the present invention.

In some embodiments, the tool case (10) also includes a locking mechanism for retaining the lid member (14) in the closed position. Any suitable type of a locking mechanism, such as a clasp, can be used in accordance with the present invention. In the exemplary embodiment shown in FIG. 1, the locking mechanism includes two clasps (20) positioned on the lid member (14) adjacent to the handle portion (18) and two mating protrusions (21) positioned on the corresponding part of the base member (12). Additionally, in some embodiments, the handle (18) functions as the locking mechanism.

Figure 2:
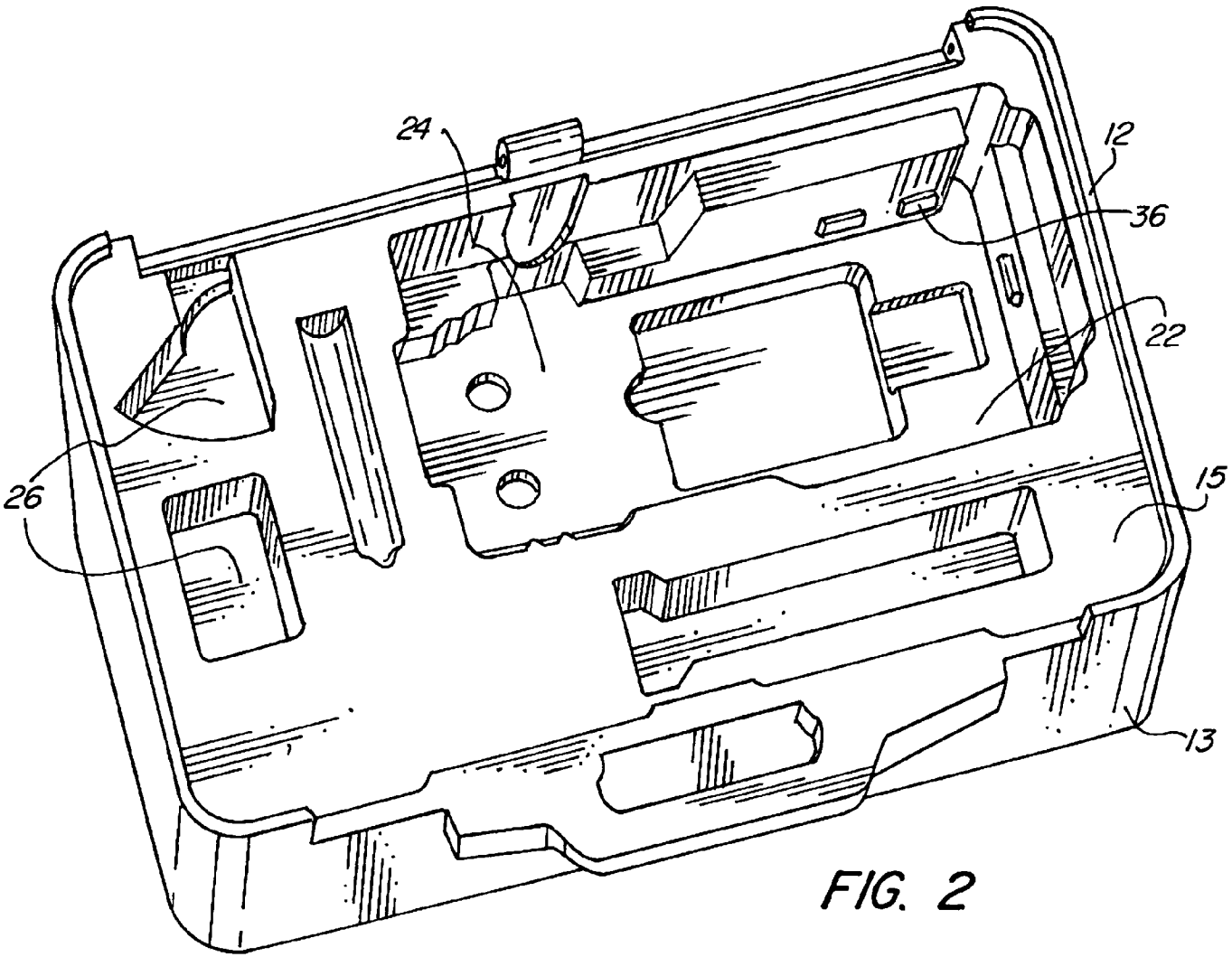
FIG. 2 is a top isometric view of a base member of the tool case shown in FIG. 1.

As shown in FIG. 2, the base member (12) includes a tool cavity (22) formed at least partially by the interior wall (13) in the base member (12). The tool cavity (22) has an inner surface (24) formed by a bottom surface and four side walls of the cavity. Any of various configurations may be employed for the inner surface (24) of the tool cavity (22), including various recesses and/or holes therethrough in whatever shapes and sizes as may be appropriate to accommodate various tools or tool collections that it may be positioned in the tool cavity (22). Various mold planes and punches can be used to create any variety of through-holes, blind holes, flanges, or sidewalls for accommodating, and providing support for, the variety of tools or tool collections.

The interior wall (15) of the base member (12) further includes a plurality of accessory cavities (26) that accommodate a plurality of accessories that come with a particular type of a tool or a tool collection to be packaged in the tool case (10). The accessory cavities (26) can have various shapes, sizes and configurations that are suitable to accommodate various accessories, and may be manufactured by utilizing various blow molding processes described above to create the necessary shapes.

The interior wall of the lid member (14) may also include a tool cavity that accommodates at least a portion of the tools or tool collections received in the tool cavity (22) of the base member (12) when the tool case (10) is in the closed position, as shown in FIG. 1. Similarly, the interior wall of the lid member (14) can include a plurality of accessory cavities that at least partially accommodate various tool accessories positioned in the accessory cavities (26) of the base member (12) when the tool case (10) is closed, as illustrated in FIG. 1. However, it should be noted that the tool cavity (22) and the plurality of accessory cavities (26) in the base member (12) can accommodate the tools or tool accessories in their entirety, in which case the interior wall of the lid member (14) has a flat surface that covers the tool cavity (22) and the plurality of accessory cavities (26) when in the closed position.

Figure 3:
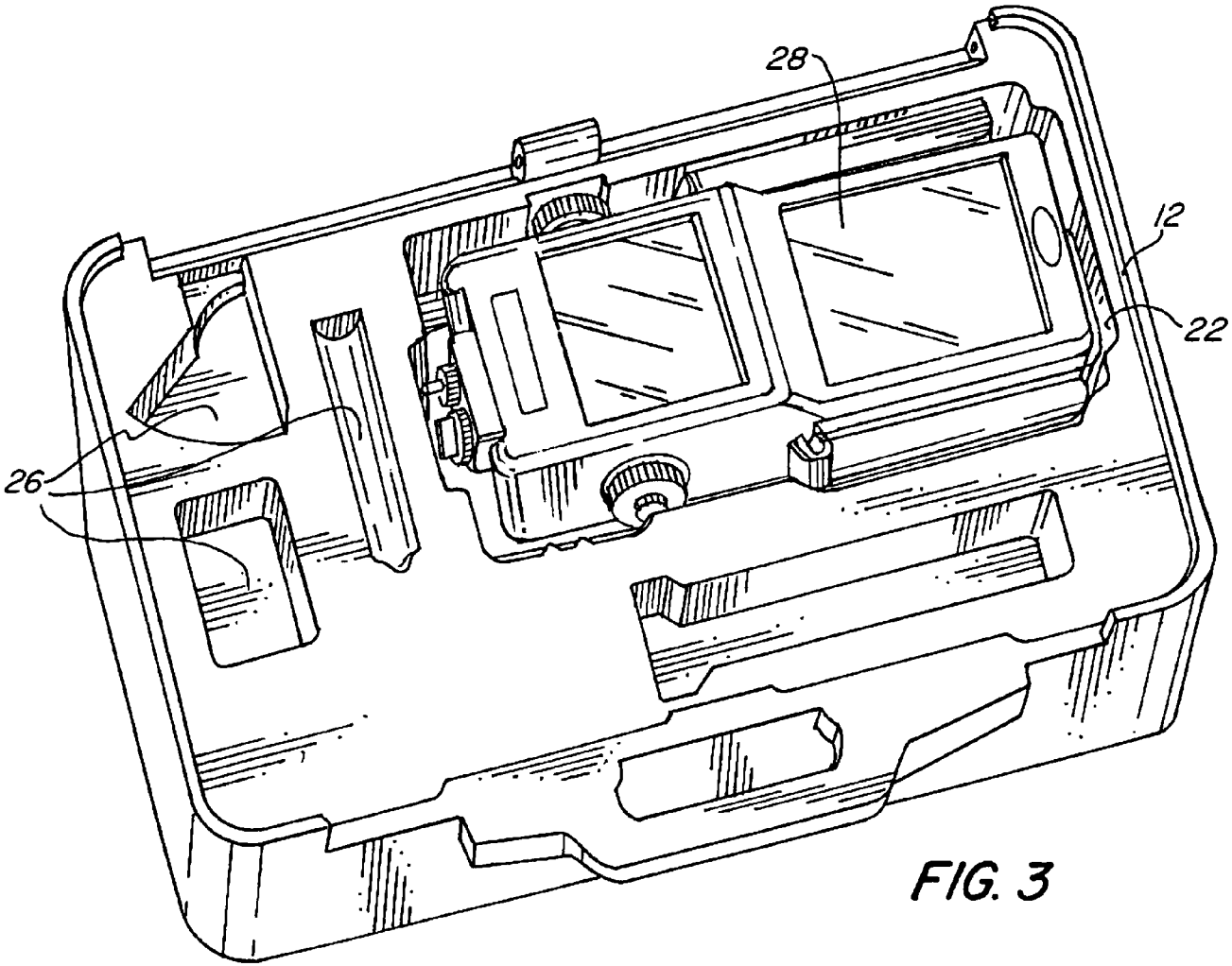
FIG. 3 is top isometric view of the tool case shown in FIG. 1, illustrating a first tool arrangement in a tool cavity.

FIG. 3 illustrates a tool (28) received in the tool cavity (22) of the base member (12). In an advantageous embodiment, the tool (28) is the largest of the tool selection to be packaged in the tool case (10). As shown, an outer periphery of the tool (28) corresponds to the inner surface (24) of the tool cavity (22) such that the tool fits snugly into the tool cavity (22) and is securely retainer therein. In some embodiments, the tool (28) can be further secured in the cavity (22) by any suitable connector or a plurality of connectors. For example, the tool cavity (22) can include protrusions on its inner surface (24)

that engage with mating protrusions on the tool (28). Similarly, the inner surface (24) of the tool cavity (22) can have recesses that mate with protrusions on the tool (28). It is understood that the tool cavity (22) can also accommodate a collection of tools having an outer periphery that corresponds to the inner surface (24) of the tool cavity (22).

Figure 4:
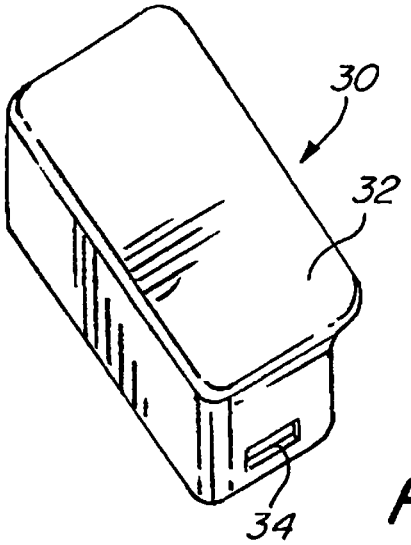
FIG. 4 is a top perspective view of an adapter according to an exemplary embodiment of the present invention.

The tool kit of the present invention further includes at least one adapter for accommodating a particular tool or tool collection. An exemplary embodiment of the adapter (30) is illustrated in FIG. 4. The adapter (30) is preferably, but not necessarily, manufactured by double wall blow molding process such that the adapter (30) has an outer wall (32) and an internal space enclosed by the outer wall. The adapter (30) can have any shape, size and configuration depending on the shape and configuration of the tool cavity (22) and the type of tool(s) to be accommodated by the adapter (30). In an advantageous embodiment, the outer wall (32) of the adapter (30) has a shape that corresponds to the inner surface (24) of the tool cavity (22) such that the adapter fits snugly into the cavity (22).

Figure 5:
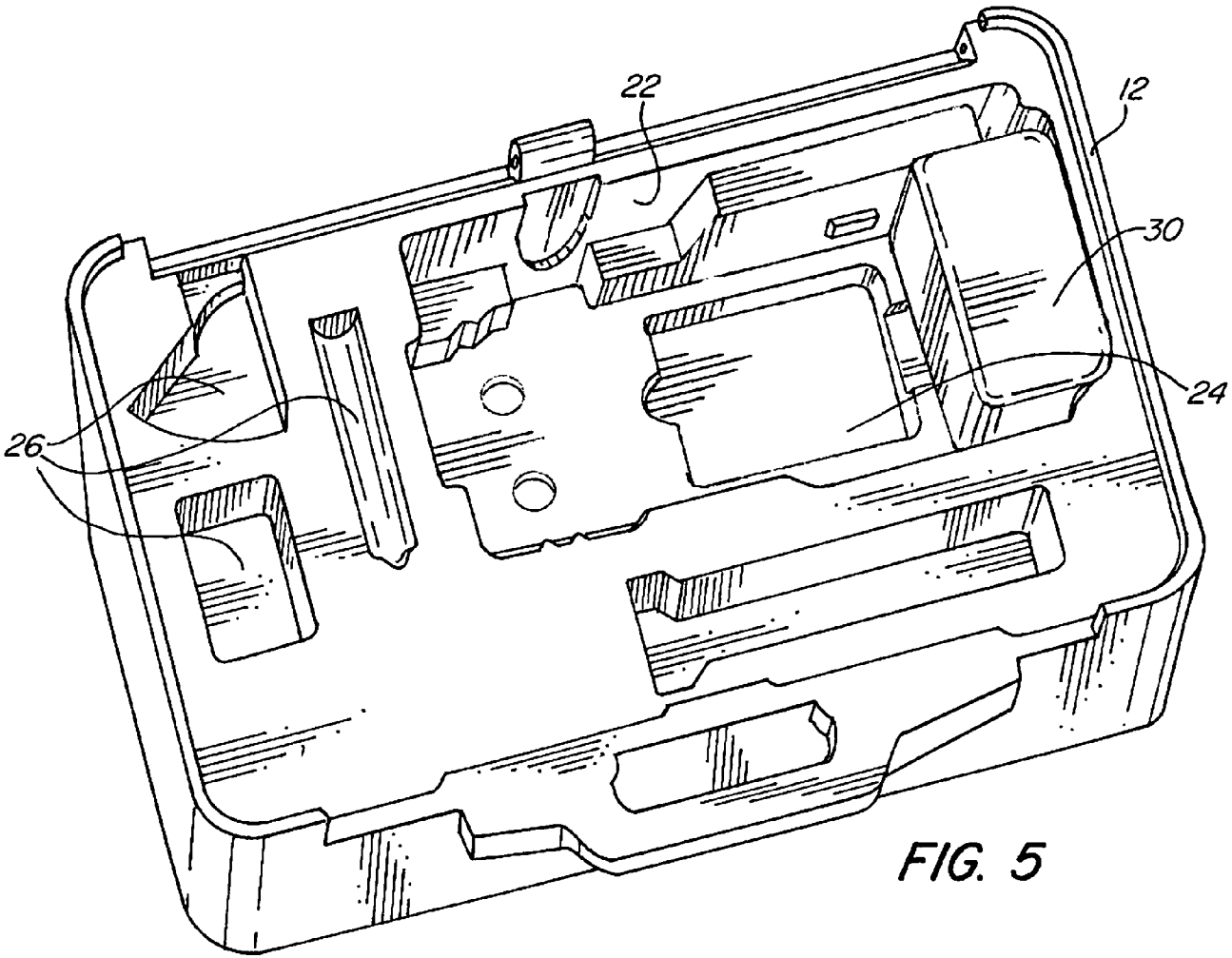
FIG. 5 is a top isometric view of the tool case shown in FIG. 1, illustrating the adapter positioned in the tool cavity.

The tool kit of the present invention further includes at least one connector for connecting the adapter (30) to the tool cavity (22) in the tool case. The connector can be of any suitable type. In some embodiments, the adapter (30) includes at least one first connector component that engages at least one second connector component positioned in the inner surface of the tool cavity. In the exemplary embodiment illustrated in FIG. 4, the first connector component (34) is an integrally molded female component, or a recess, provided in the outer wall (32) of the adapter (30). The recess corresponds to an integrally molded male component, or a protrusion (36), positioned in the inner surface of the tool cavity (22), as shown in FIG. 1. When the adapter (30) is received in the tool cavity (22), as shown in FIG. 5, the protrusion (36) mates with the recess (34) such that the adapter (30) is securely retained in the cavity (22). It is understood that any other type of connector can be used to connect the adapter to the tool cavity in accordance with the present invention. For example, mechanical fasteners, e.g. rivets, can also be used to removably and/or permanently attach the adapter to the tool cavity, as described below.

As seen in FIG. 5, the adapter (30) reduces only the length of the tool cavity (22), such that a tool having a length that is smaller than the length of the tool cavity (22) can be accommodated in the cavity. It should be noted that other adapter configurations can be provided that alter the width and/or height of the tool cavity, as described further below.

Figure 6:
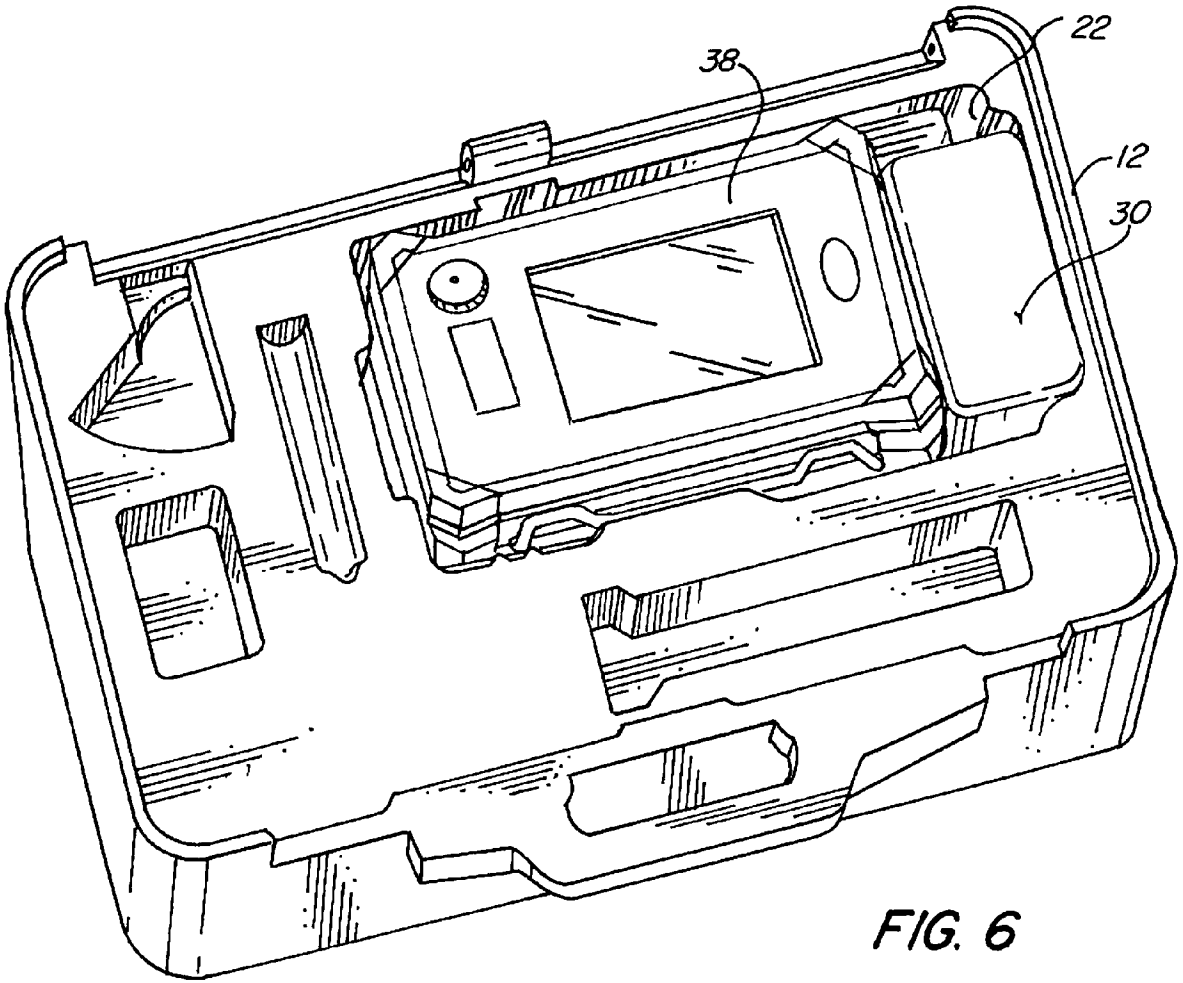
FIG. 6 a top isometric view of the tool case with the adapter shown in FIG. 4, illustrating a second tool arrangement in the tool cavity.

FIG. 6 illustrates the tool case with the adapter (30) received in the tool cavity (22) and another tool (38) positioned in the tool cavity. The outer wall of the adapter (30) and the inner surface of the tool cavity (22) correspond to the outer periphery of the tool (38) such that the tool is tightly fitted into the cavity. Additionally, as described above, the tool cavity (22) can include a plurality of connector components that corresponds to the connector components on the tool (38) to further secure the tool (38) in the tool cavity (22).

Figure 7:
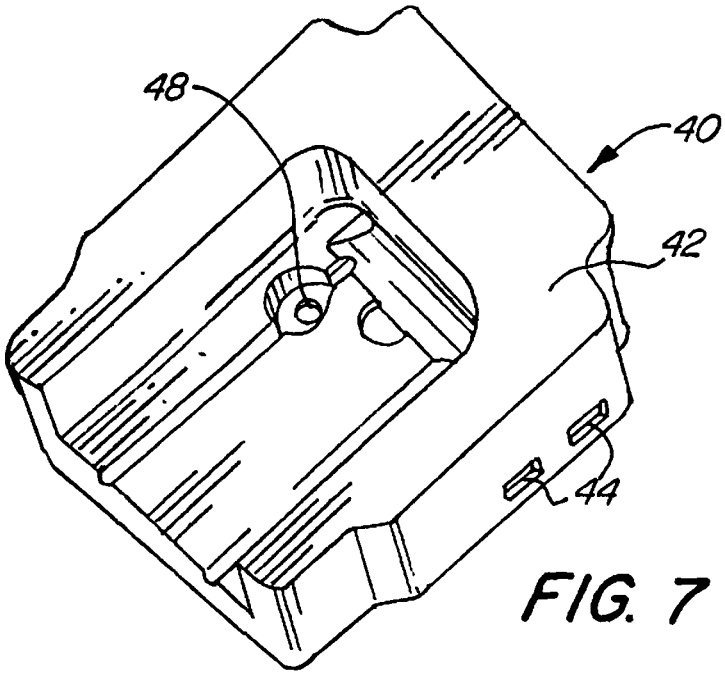
FIG. 7 is a top isometric view of another adapter according to an exemplary embodiment of the present invention.

The tool kit of the present invention preferably includes another adapter (40), shown in FIG. 7, for accommodating a third tool having a different size the other two tools. Similar to the first adapter (30), the second adapter (40) is preferably blow molded such that the adapter (40) has an outer wall (42) and an internal space enclosed by the outer wall. In an advantageous embodiment, the outer wall (42) of the adapter (40) is shaped to correspond to the inner surface (24) of the tool cavity (22) to ensure a tight fit when the adapter (40) is received into the cavity (22).

The outer wall (42) of the adapter (40) further includes a plurality of recesses (44) positioned on the side wall of the adapter. The recesses (44) corresponds to the protrusions (36) provided on the inner surface (24) of the tool cavity (22), as shown in FIG. 1. When the adapter (40) is placed into the cavity (22), the protrusions (36) mate with the recesses (44) such that the adapter (40) is securely retained in the cavity (22). It should be understood that any other type of connector can be use to connect the adapter to the tool cavity in accordance with the present invention. The adapter (40) can also include an opening (48) for receiving a mechanical connector, such as a rivet, for attachment to the tool cavity (22).

Figure 8:
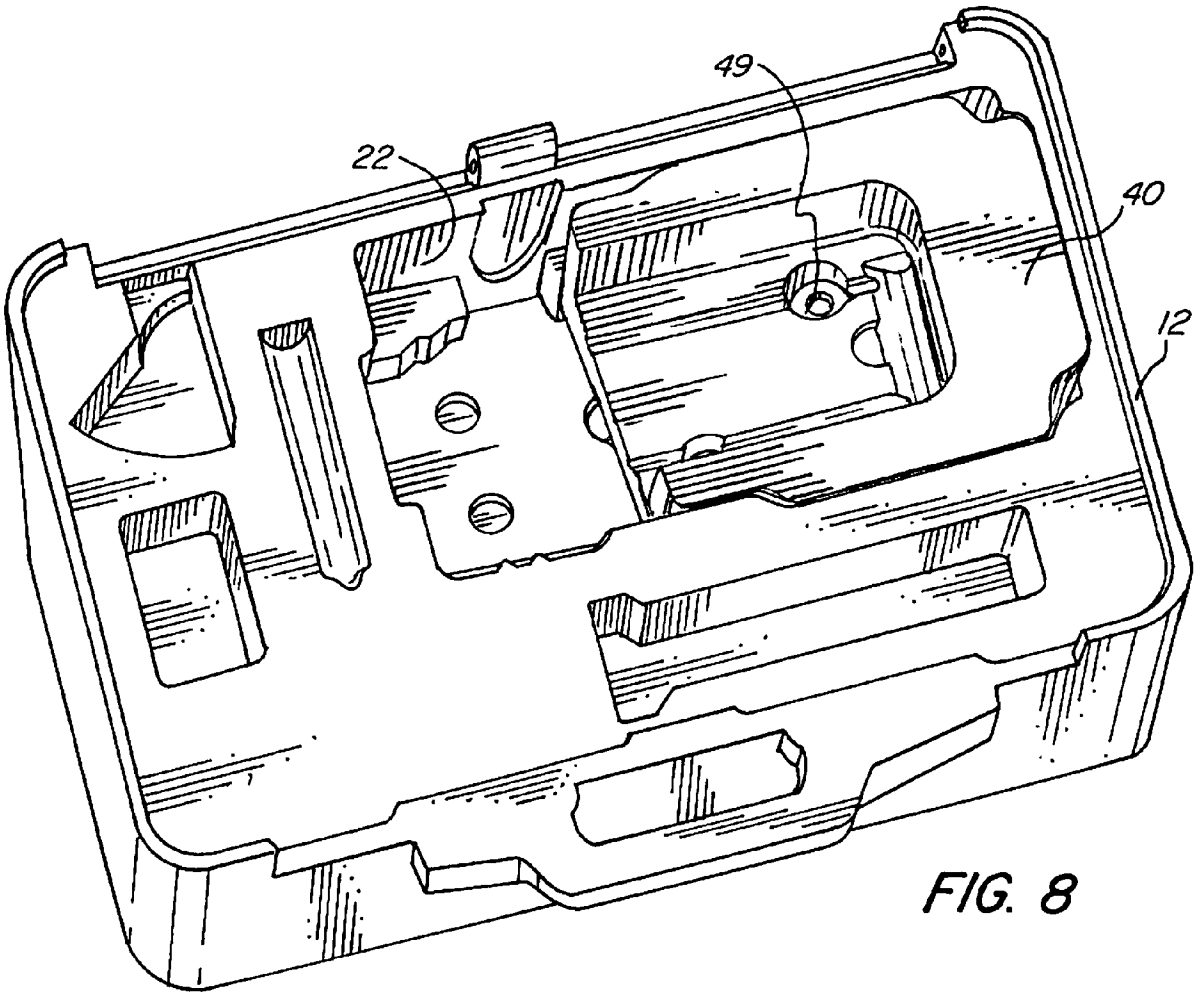
FIG. 8 is a top isometric view of the tool case shown in FIG. 1, illustrating the adapter positioned in the tool cavity.
Figure 9:
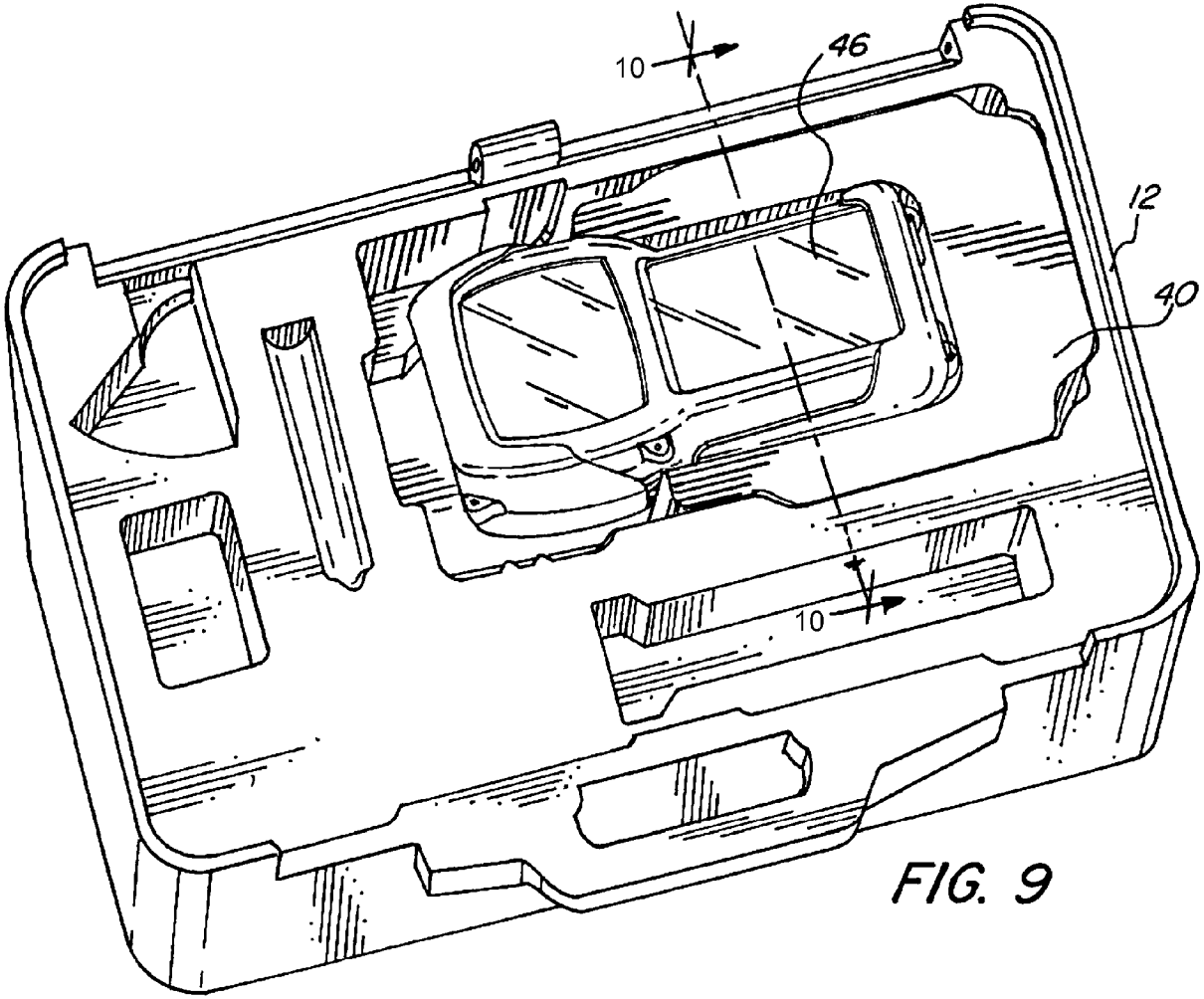
FIG. 9 a top isometric view of the tool case with the adapter shown in FIG. 8, illustrating a third tool arrangement in the tool cavity.

FIG. 8 illustrates the adapter (40) received in the tool cavity (22) of the base member (12). The adapter (40) is shaped such that it reduces the length, width and height of the tool cavity (22) to accommodate the smallest tool (46) of the selection of tools in the kit, as shown in FIG. 9. The outer periphery of the tool (46) corresponds to the outer wall (42) of the adapter (40) positioned in the tool cavity (22), such that the tool (46) fits tightly into the cavity and is thus securely retained therein. As discussed above, the outer wall (42) of the adapter (40) and the inner surface (24) of the tool cavity (22) can provided with a plurality of connectors that mate with the corresponding connectors provided on the tool (46) to further secure the tool (46) in the tool cavity (22). Additionally, the adapter (40) can be connected to the tool cavity (22) by at least one mechanical connector (49), such as a rivet, that fits into the opening (48) in the adapter (40) and extends into the bottom wall of the tool cavity (22). It is understood that the adapter (40) can be attached to the tool cavity (22) by the recesses (44) and protrusions (36), by the mechanical connectors (49), or by a combination of both in accordance with the present invention.

Figure 10:
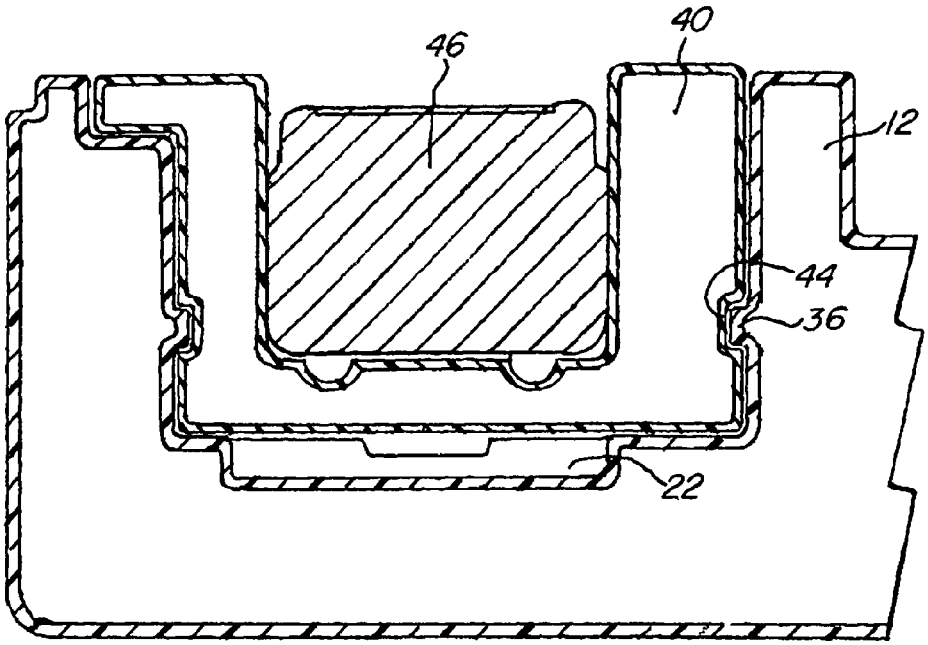
FIG. 10 a cross-sectional view of the tool case shown in FIG. 9 along line A-A.

FIG. 10 shows a cross-section of the tool kit (10) taken along the line A-A in FIG. 9, showing the adapter (40) and the tool (46) positioned in the tool cavity (22). As shown in this figure, the outer wall of the adapter (40) corresponds to the shape of the inner surface of the cavity (22) such that there is a tight fit between the adapter and the cavity. Additionally, the protrusions (36) provided in the inner surface of the tool cavity (22) are received in the recesses (44) provided on the outer wall of the adapter (40) to further secure the adapter in the tool cavity. The tool (46) is positioned into the cavity (22) such the adapter (40) receives at least a portion of the tool (46). The outer periphery of the tool portion received in the adapter (40) corresponds to the outer wall of the adapter, as shown in this figure, such that the tool (46) is securely retained in the tool cavity (22).

The novel tool kit of the present invention can be used with various types of tools and tool accessories. For example, in some embodiments, the tool kit is used to package an electronic test instrument kit, which includes power supplies, cables, wires, a printer and test standards which are common across the product line. The tool kit is capable of housing three different instrument housing styles, which are accommodated by two different adapters that come with the tool kit.

In additional embodiments, the tool kit of the present invention is used to package various power tools and accessories. For example, the tool kit can accommodate a cable crimper that uses a single handle, motor and battery assembly with a variety of cutting and crimping heads. Different adapters provided with the tool kit accommodate several variations of the tool body and head assemblies.

Thus, the tool kit of the present invention is advantageous over known prior art tool kits in that it is more economical and allows manufacturers to package a greater variety of tools or tool collections with the corresponding accessories at a reduced cost, which is achieved by providing a master tool case with a plurality of adapters that accommodate different tool variations. The tool kit of the present invention is also advantageous in that it allows the manufacturers to design new adapters to accommodate new tools as tools change or are added to the tool kits, without the need to manufacture a new tool case.

It would be appreciated by those skilled in the art that various changes and modifications can be made to the illustrated embodiment without departing from the spirit of the present invention. All such modifications and changes are intended to be covered hereby.

What is claimed is:

1. A tool kit accommodating a first tool and a second tool having different sizes, comprising:

a tool case comprising:

a base member, a lid member hingedly connected to said base member, and a tool cavity formed by at least one of said base member and said lid member and having an inner surface;

at least one adapter fittable in said tool cavity and having an outer surface that corresponds to the inner surface of said tool cavity;

the first tool having an outer periphery that corresponds to the inner surface of said tool cavity such that the first tool is securely retained in said tool cavity; and the second tool having an outer periphery that corresponds to the inner surface of said tool cavity and the outer surface of said at least one adapter received in said tool cavity such that the second tool is securely retained in said tool cavity.

2. The tool kit of claim 1, further comprising a plurality of accessory cavities formed by at least one of said base member and said lid member for accommodating a plurality of tool accessories.

3. The tool kit of claim 1, wherein each of said base member and said lid member are blow molded such that each of said base member and said lid member have an exterior wall, an interior wall, and an internal space between said exterior wall and said interior wall.

4. The tool kit of claim 1, further comprising at least one connector for removably connecting said at least one adapter to said tool cavity.

5. The tool kit of claim 4, wherein said at least one connector comprises at least one first connector component positioned on the inner surface of said tool cavity and at least one second connector component positioned on the outer surface of said at least one adapter.

6. The tool kit of claim 5, wherein said at least one first connector component is a male connector component, and said at least one second connector component is a female connector component.

7. The tool kit of claim 1, wherein said at least one adapter comprises a first adapter removably fittable in said tool cavity accommodating the second tool and a second adapter removably fittable in said tool cavity accommodating a third tool, wherein an outer periphery of the third tool corresponds to the inner surface of said tool cavity and an outer surface of said second adapter received in said tool cavity such that the third tool is securely retained in said tool cavity.

8. The tool kit of claim 1, further comprising a handle attached to said tool case to facilitate carrying of the tool case.

9. The tool kit of claim 1, wherein said lid member and said base member are movable from an open position to a closed position.

10. The tool kit of claim 1, further comprising at least one locking mechanism for retaining said lid member in the closed position.

11. The tool kit of claim 1, wherein said tool cavity is formed at least partially by an inner wall of said lid member and an inner wall of said base member.

12. The tool kit of claim 1, wherein said tool cavity is formed by an inner wall of said base member.

13. The tool kit of claim 1, wherein the first tool comprises at least one of a single tool and a plurality of tools.

14. The tool kit of claim 1, wherein the second tool comprises at least one of a single tool and a plurality of tools.

15. The tool kit of claim 7, wherein the third tool comprises at least one of a single tool and a plurality of tools.

16. The tool kit of claim 1, wherein said tool cavity has a length, a width and a height, and wherein said at least one adapter alters at least one of the length, width and height of said tool cavity when positioned in said cavity.

17. The tool kit of claim 1, wherein said at least one adapter is blow molded such that the adapter has the outer wall and an internal space enclosed by said outer wall.

18. A method of packaging a first tool and a second tool having different sizes in a tool case, comprising the steps of:

providing a tool case comprising:

a base member, a lid member hingedly connected to said base member, and a tool cavity formed by at least one of said base member and said lid member and having an inner surface;

positioning at least one adapter in said tool cavity, said at least one adapter having an outer surface that corresponds to the inner surface of said tool cavity; and positioning the first tool having an outer periphery in said tool cavity such that the inner surface of said tool cavity corresponds to the outer periphery of the first tool; and positioning the second tool having an outer periphery in said tool cavity such that the inner surface of said tool cavity and the outer surface of said at least one adapter received in said tool cavity correspond to the outer periphery of the second tool.

19. The method of claim 18, wherein the step of positioning at least one adapter in said tool cavity comprises engaging at least one first connector component positioned on the inner surface of said tool cavity with at least one second connector component positioned on the outer surface of said at least one adapter.

20. The method of claim 18, further comprising the step of attaching a handle to said tool case to facilitate carrying of said case.

21. The method of claim 18, wherein each of said base member and said lid member are blow molded such that each of said base member and said lid member have an exterior wall, an interior wall, and an internal space between said exterior wall and said interior wall.

22. The method of claim 18, further comprising the step of positioning at least one tool accessory in an accessory cavity provided in said tool case.

23. The method of claim 18, wherein the first tool comprises at least one of a single tool and a plurality of tools.

24. The method of claim 18, wherein the second tool comprises at least one of a single tool and a plurality of tools.

* * * * *